US005313531A

United States Patent [19]

Jackson

[11] Patent Number: 5,313,531

[45] Date of Patent: May 17, 1994

[54] METHOD AND APPARATUS FOR SPEECH ANALYSIS AND SPEECH RECOGNITION

[75] Inventor: John W. Jackson, Southlake, Tex.

[73] Assignee: International Business Machines Corporation, Armonk, N.Y.

[21] Appl. No.: 610,888

[22] Filed: Nov. 5, 1990

[51] Int. Cl.[5] ..... G10L 5/00

[52] U.S. Cl. ..... 381/41; 395/2.4

[58] Field of Search ..... 381/51, 43, 42, 41, 381/48, 49; 395/2, 2.2, 2.4, 2.29, 2.67, 2.76, 2.77, 2.6, 2.16

[56] References Cited

U.S. PATENT DOCUMENTS

| | | | |
|---|---|---|---|
| 3,588,353 | 6/1971 | Martin | 381/51 X |
| 3,603,738 | 9/1971 | Focht | 381/49 |
| 4,748,670 | 5/1988 | Bahl et al. | 381/43 |
| 4,776,017 | 10/1988 | Fujimoto | 381/43 |
| 4,809,332 | 2/1989 | Jongman et al. | 381/43 |
| 4,829,574 | 5/1989 | Dewhurst et al. | 381/41 |
| 4,852,170 | 7/1989 | Boedeaux | 381/41 |
| 4,933,973 | 6/1990 | Porter | 381/43 |

OTHER PUBLICATIONS

Flanagan "Speech Analysis Synthesis and Perception", Springer-Verlag 1972 pp. 141-147, 150-155.

*Primary Examiner*—Dale M. Shaw

*Assistant Examiner*—Kee M. Tung

*Attorney, Agent, or Firm*—Andrew J. Dillon

[57] ABSTRACT

A method and apparatus are disclosed for speech analysis and speech recognition. Each speech utterance under examination in accordance with the method of the present invention is digitally sampled and represented as a temporal sequence of data frames. Each data frame is then analyzed by the application of a Fast Fourier Transform (FFT) to obtain an indication of the energy content of each data frame in a plurality of frequency bands or bins. An indication of each of the most significant frequency bands, in terms of energy content, are then plotted by bin number for all data frames and graphically combined to create a power content signature for the speech utterance which is indicative of the movement of audio power through the audio spectrum over time for that utterance. By comparing the power content signature of an unknown speech utterance to a number of previously stored power content signatures, each associated with a known utterance, it is possible to identify an unknown speech utterance with a high degree of accuracy. In one preferred embodiment of the present invention, comparisons of power content signatures from unknown speech utterances are made with stored power content signatures utilizing a least squares fit or other suitable technique.

19 Claims, 4 Drawing Sheets

METHOD AND APPARATUS FOR SPEECH ANALYSIS AND SPEECH RECOGNITION

BACKGROUND OF THE INVENTION

1. Technical Field

The present invention relates in general to the field of speech utterance analysis and in particular to the field of recognition of unknown speech utterances. Still more particularly, the present invention relates to a method and apparatus for speech analysis and recognition which utilizes the power content of a speech utterance over time.

2. Description of the Related Art

Speech analysis and speech recognition algorithms, machines and devices are becoming more and more common in the prior art. Such systems have become increasingly powerful and less expensive. Speech recognition systems are typically "trained" or "untrained." A trained speech recognition system is a system which may be utilized to recognize a speech utterance by an individual speaker after having been "trained" by that speaker utilizing a repetitive pronunciation of the vocabulary in question. A "untrained" speech recognition system is a system which attempts to recognize an unknown speech utterance by an unknown speaker by comparing various acoustic parameters of that utterance to a previously stored finite number of templates which are utilized to represent various known utterances.

Most speech recognition systems in the prior art are frame-based systems, that is, these systems represent speech as a sequence of temporal frames, each of which represents the acoustic parameters of a speech utterance at one of a succession of brief time periods. Such systems typically represent the speech utterance to be recognized as a sequence of spectral frames, in which each frame contains a plurality of spectral parameters, each of which representing the energy at one of a series of different frequency bands. Typically such systems compare the sequence of frames to be recognized against a plurality of acoustic models, each of which describes, or models, the frames associated with a given speech utterance, such as a phoneme, word or phrase.

The human vocal track is capable of producing multiple resonances simultaneously. The frequencies of these resonances change as a speaker moves his tongue, lips or other parts of his vocal track to make different speech sounds. Each of these resonances is referred to as a formant, and speech scientists have found that many individual speech sounds, or phonemes may be distinguished by the frequency of the first three formants. Many speech recognition systems have attempted to recognize an unknown utterance by an analysis of these formant frequencies; however, the complexity of the speech utterance makes such systems difficult to implement.

Many researchers in the speech recognition areas believe that changes in frequency are important to enable a system to distinguish between similar speech sounds. For example, it is possible for two different frames to have similar spectral parameters and yet be associated with very different sounds, because one sound will occur in a context of a rising formant while the other occurs in the context of a falling formant. U.S. Pat. No. 4,805,218 discloses a system which attempts to implement a speech recognition system by making use of information about changes in the acoustic parameters of the speech energy.

Other systems in the prior art have attempted to explicitly detect frequency changes by means of formant tracking. Formant tracking involves analyzing the spectrum of speech energy at successive points in time and determining at each such time the location of the major resonances, or formants, of the speech signal. Once the formants have been identified at successive points in time, their resulting pattern over time may be supplied to a pattern recognizer which is utilized to associate certain formant patterns with selected phonemes.

The goal of all such speech recognition systems is to create a system which can provide a high degree of accuracy in detecting and understanding unknown speech utterances by a broad spectrum of speakers. Thus, it should be obvious that a need exists for a speech recognition system which may be utilized to analyze and recognize unknown speech utterances with a high degree of accuracy.

SUMMARY OF THE INVENTION

It is therefore an object of the present invention to provide an improved method and apparatus for speech utterance analysis.

It is another object of the present invention to provide an improved method and apparatus for the recognition of unknown speech utterances.

It is yet another object of the present invention to provide an improved method and apparatus for speech analysis and recognition which utilizes the power content of a speech utterance over time.

The foregoing objects are achieved as is now described. The method and apparatus of the present invention digitally samples each speech utterance under examination and represents that speech utterance as a temporal sequence of data frames. Each data frame is then analyzed by the application of a Fast Fourier Transform (FFT) to obtain an indication of the energy content of each data frame in a plurality of frequency bands or bins. An indication of each of the most significant frequency bands, in terms of energy content, are then plotted by bin number for all data frames and graphically combined to create a power content signature for the speech utterance which is indicative of the movement of audio power through the audio spectrum over time for that utterance with a high degree of accuracy. By comparing the power content signature of an unknown speech utterance to a number of previously stored power content signatures, each associated with a known utterance, it is possible to identify an unknown speech utterance with a high degree of accuracy. In one preferred embodiment of the present invention, comparisons of power content signatures from unknown speech utterances are made with stored power content signatures utilizing a least squares fit or other suitable technique.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
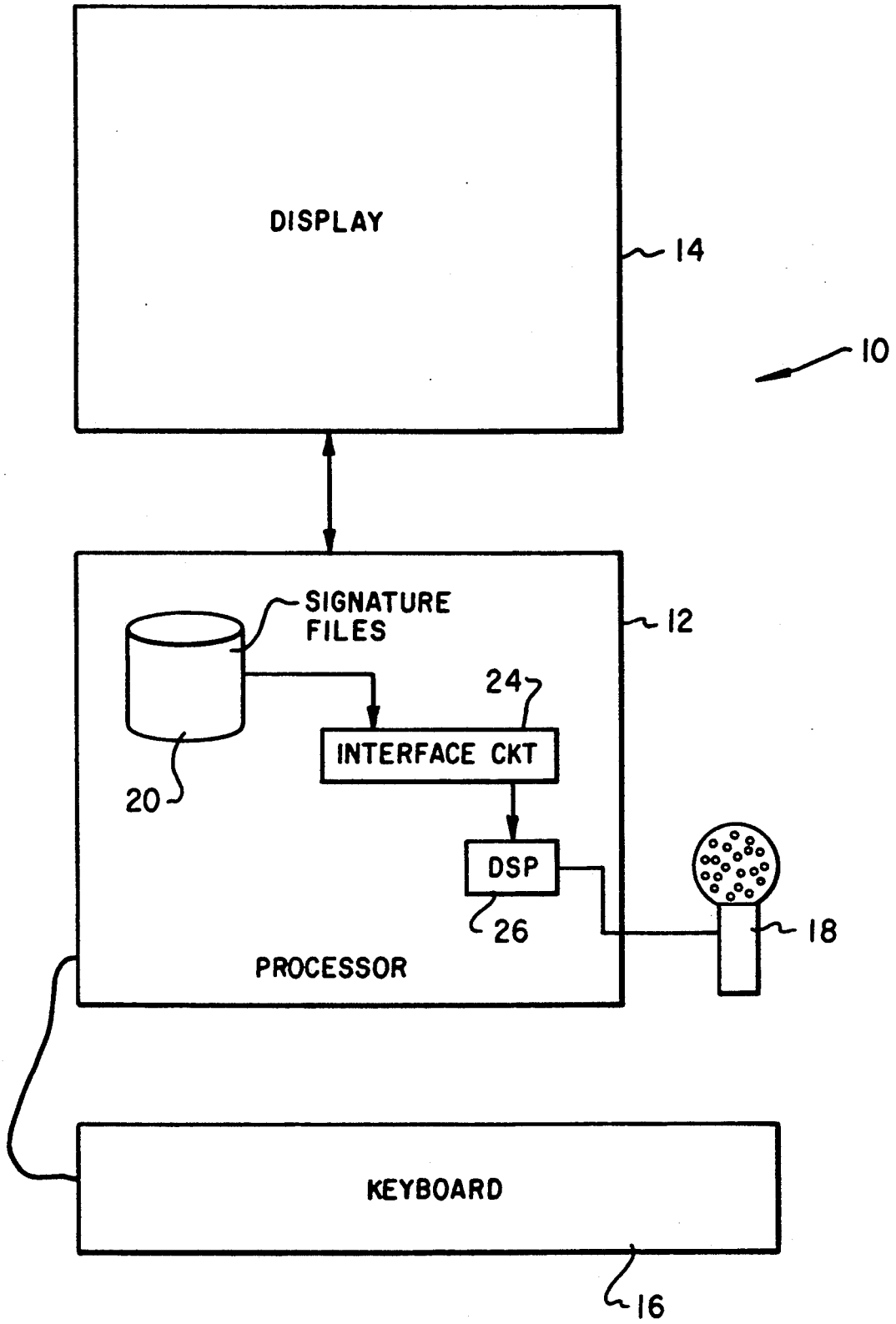
Fig. 1 Prior Art
FIG. 1 is a block diagram of a computer system which may be utilized to implement the method and apparatus of the present invention.

With reference now to the figures and in particular with reference to FIG. 1, there is depicted a block diagram of a computer system 10 which may be utilized to implement the method and apparatus of the present invention. As is illustrated, a computer system 10 is depicted. Computer system 10 may be implemented utilizing any state-of-the-art digital computer system having a suitable digital signal processor disposed therein. For example, computer system 10 may be implemented utilizing an IBM pS/2 type computer which includes an IBM Audio Capture & Playback Adapter (ACPA).

Also included within computer system 10 is display 14. Display 14 may be utilized, as those skilled in the art will appreciate, to display graphic indications of various speech waveforms within a digital computer system. Also coupled to computer system is computer keyboard 16, which may be utilized to enter data and select various files stored within computer system 10 in a manner Well known in the art. Of course, those skilled in the art will appreciate that a graphical pointing device, such as a mouse or light pen, may also be utilized to enter commands or select appropriate files within computer system 10.

Still referring to computer system 10, it may be seen that processor 12 is depicted. Processor 12 is preferably the central processing unit for computer system 10 and, in the depicted embodiment of the present invention, preferably includes an audio adapter which may be utilized to implement the method and apparatus of the present invention. One example of such a device is the IBM Audio Capture & Playback Adapter (ACPA).

As is illustrated, audio signature file 20 is depicted as stored within memory within processor 12. The output of each file may then be coupled to interface circuitry 24. Interface circuitry 24 is preferably implemented utilizing any suitable application programming interface which permits the accessing of audio signature files which have been created utilizing the method of the present invention.

Thereafter, the output of interface circuit 24 is coupled to digital signal processor 26. Digital signal processor 26, in a manner which will be explained in greater detail herein, may be utilized to digitize and analyze human speech utterances for speech recognition in accordance with the method and apparatus of the present invention. Human speech utterances in analog form are typically coupled to digital signal processor 26 by means of audio input device 18. Audio input device 18 is preferably a microphone.

Figure 2:
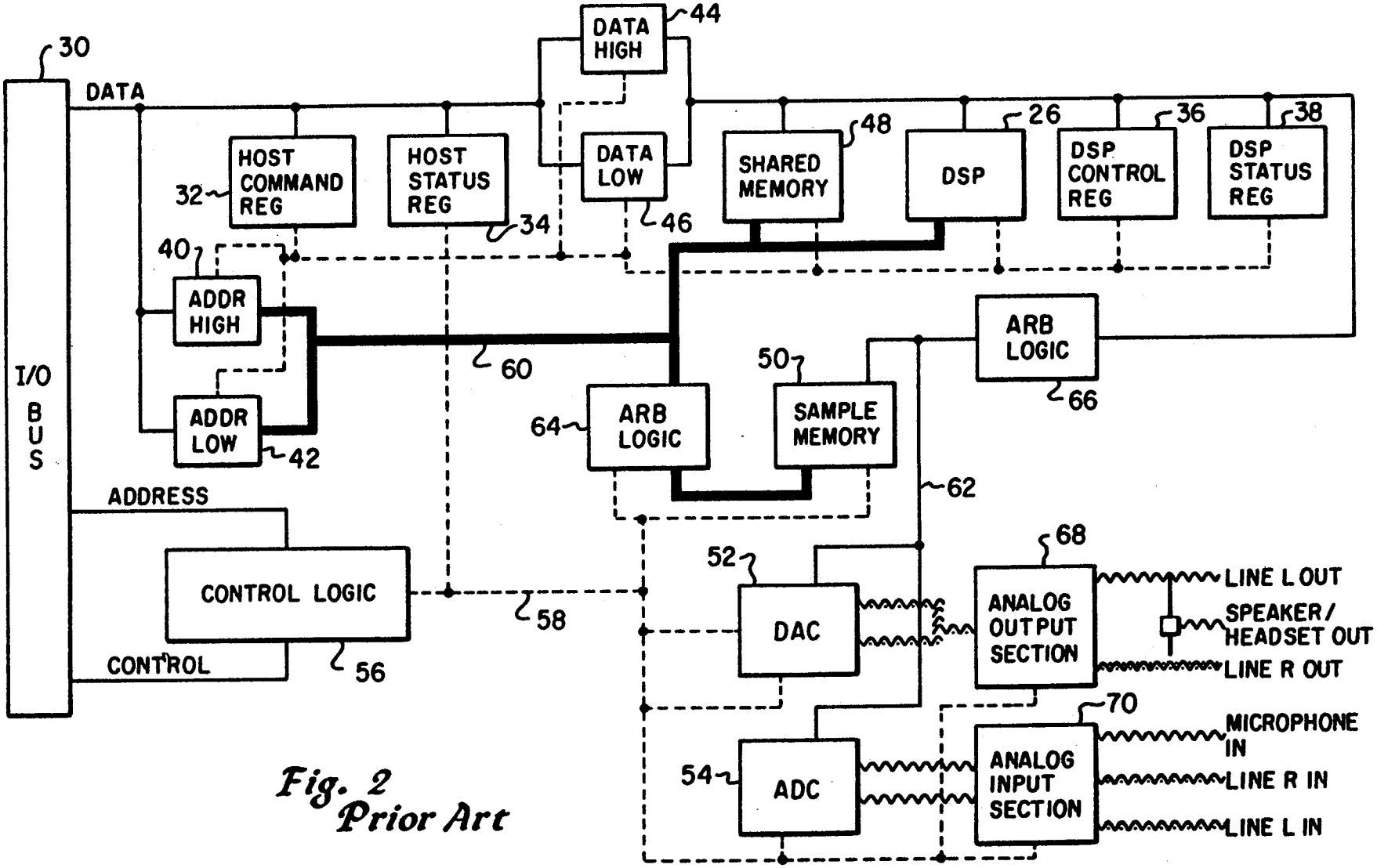
Fig. 2 Prior Art
FIG. 2 is a block diagram of an audio adapter which includes a digital signal processor which may be utilized to implement the method and apparatus of the present invention.

Referring now to FIG. 2, there is depicted a block diagram of an audio adapter which includes digital signal processor 26 which may be utilized to implement the method and apparatus of the present invention. As discussed above, this audio adapter may be simply implemented utilizing the IBM Audio Capture & Playback Adapter (ACPA) which is commercially available. In such an implementation, digital signal processor 26 is provided by utilizing a Texas Instruments TMS 320C25, or other suitable digital signal processor.

As illustrated, the interface between processor 12 and digital signal processor 26 is I/O bus 30. Those skilled in the art will appreciate that I/O bus 30 may be implemented utilizing the Micro Channel or PC I/O bus which are readily available and understood by those skilled in the personal computer art. Utilizing I/O bus 30, processor 12 may access the host command register 32. Host command register 32 and host status register 34 are utilized by processor 12 to issue commands and monitor the status of the audio adapter depicted within FIG. 2.

Processor 12 may also utilize I/O bus 30 to access the address high byte latched counter and address low byte latched counter which are utilized by processor 12 to access shared memory 48 within the audio adapter depicted within FIG. 2. Shared memory 48 is preferably an 8K×16 fast static RAM which is "shared" in the sense that both processor 12 and digital signal processor 26 may access that memory. As will be discussed in greater detail herein, a memory arbiter circuit is utilized to prevent processor 12 and digital signal processor 26 from accessing shared memory 48 simultaneously.

As is illustrated, digital signal processor 26 also preferably includes digital signal processor control register 36 and digital signal processor status register 38 which are utilized, in the same manner as host command register 32 and host status register 34, to permit digital signal processor 26 to issue commands and monitor the status of various devices within the audio adapter.

Processor 12 may also be utilized to couple data to and from shared memory 48 via I/O bus 30 by utilizing data high byte bi-directional latch 44 and data low-byte bi-directional latch 46, in a manner well known in the art.

Sample memory 50 is also depicted within the audio adapter of FIG. 2. Sample memory 50 is preferably a 2K by 16 static ram which may be utilized by digital signal processor 26 for incoming samples of digitized human speech.

Control logic 56 is also depicted within the audio adapter of FIG. 2. Control logic 56 is preferably a block of logic which, among other tasks, issues interrupts to processor 12 after a digital signal processor 26 interrupt request, controls the input selection switch and issues read, write and enable strobes to the various latches and memory devices within the audio adapter depicted. Control logic 56 preferably accomplishes these tasks utilizing control bus 58.

Address bus 60 is depicted and is preferably utilized, in the illustrated embodiment of the present invention, to permit addresses of various power content signatures within the system to be coupled between appropriate devices in the system. Data bus 62 is also illustrated and is utilized to couple data among the various devices within the audio adapter depicted.

As discussed above, control logic 56 also uses memory arbiter logic 64 and 66 to control access to shared memory 48 and sample memory 50 to ensure that processor 12 and digital signal processor 26 do not attempt to access either memory simultaneously. This technique is well known in the art and is necessary to ensure that memory deadlock or other such symptoms do not occur.

Digital-to-analog converter 52 is illustrated and may be utilized to convert digital audio signals within computer system 10 to an appropriate analog signal for output. The output of digital-to-analog converter 52 is then coupled to an analog output section 68 which, preferably includes suitable filtration and amplification circuitry.

As is illustrated, the audio adapter depicted within FIG. 2 may be utilized to digitize and store analog human speech signals by coupling those signals to analog input section 70 and thereafter to analog-to-digital converter 54. Those skilled in the art will appreciate that such a device permits the capture and storing of analog human speech signals by digitization and the subsequent storing of the digital values associated with that signal. In a preferred embodiment of the present invention, human speech signals are sampled at a data rate of eighty-eight kilohertz.

Figure 3:
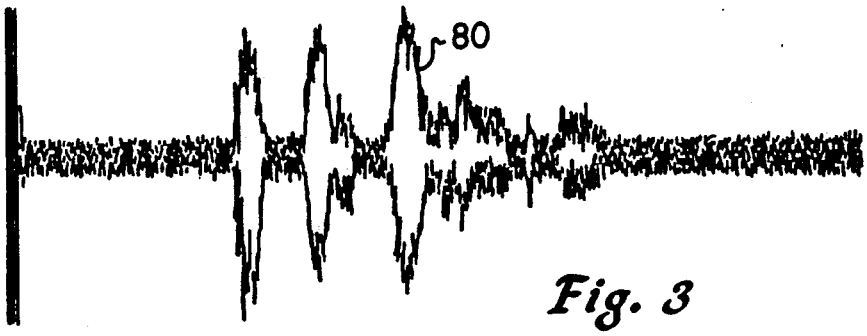
FIG. 3 is a graphic depiction of a raw amplitude envelope of a speech utterance.

With reference now to FIG. 3, there is depicted a graphic illustrating of a raw amplitude envelope 80 of a speech utterance. Those skilled in the art will appreciate that the amplitude of a speech utterance will vary, in both frequency content and amplitude, over time, in a complex manner such as that illustrated by envelope 80 of FIG. 3. The speech utterance represented by envelope 80 of FIG. 3 is then analyzed by frames of data to determine the spectral parameters contained in each frame by performing a Fast Fourier Transform (FFT) to produce a representation of the energy level at each of a series of different frequency bands. In the field of Fourier analysis each frequency band is typically referred to as a "bin" and each such signal then represents an indication of the energy content of a selected frame of envelope 80 at that frequency.

Figure 4:
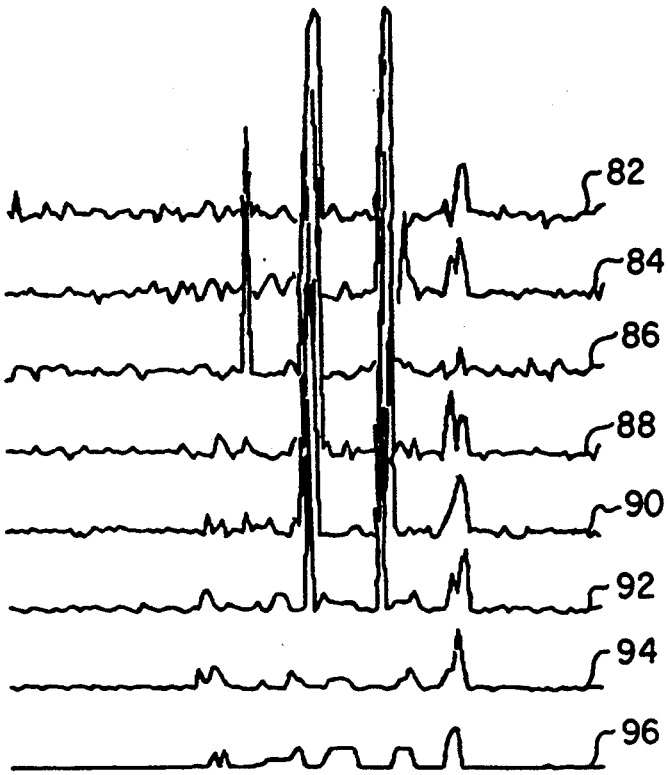
FIG. 4 is a graphic depiction of the track of the eight highest power amplitude bins after applying a Fast Fourier Transform (FFT) to the amplitude envelope of FIG. 3.

Referring now to FIG. 4, there is depicted a graphic illustration of the track of the eight highest power amplitude frequency bins within envelope 80 after applying a Fast Fourier Transform (FFT). Track 82 represents a graphic indication of each frequency bin number within each frame which contains the maximum amount of power. Next, waveform 84 depicts a plot of the frequency bin numbers for those bins within each frame which include the second highest amount of power for each frame. In like manner, the eight most significant bins in each frame, with regard to power content, are illustrated in waveforms 86, 88, 90, 92, 94 and 96. It should be noted that the vertical axis of each waveform represents a bin number, and not the actual amplitude of a signal at that point. Thus, the high points on each waveform represent points where the maximum power content is contained within the highest frequency bins.

Figure 5:
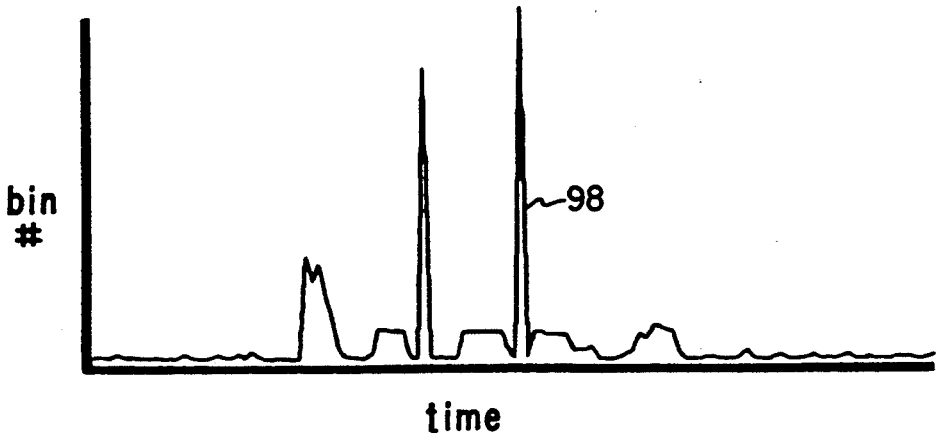
FIG. 5 is a graphic combination of the eight tracks of FIG. 4.

With reference now to FIG. 5, there is depicted a graphic combination of the eight tracks of FIG. 4. In this context the word "combination" is meant to describe the graphic depiction of waveforms 82, 84, 86, 88, 90, 92, 94 and 96 on a single set of axes and creation of a single waveform which forms an envelope for all other waveforms. As illustrated, waveform 98 depicts a graphic representation of the most significant bin numbers obtained by the Fast Fourier Transform (FFT) over time in the manner described above. Thus, waveform 98 is a power content signature which is indicative of the movement of audio power through the audio spectrum over time. The vertical axis of FIG. 5 is associated with the bin number and thus is representative of the power content at selected frequencies. The horizontal axis of FIG. 5 represents the elapsing of time during the speech utterance of FIG. 3.

The Applicant has discovered that by obtaining tracks of the variation of the power content of the most significant frequency bins after performance of a Fast Fourier Transform (FFT), a power content signature such as that depicted at reference numeral 98 of FIG. 5 may be obtained which is highly similar to all power content signatures obtained in a like manner for multiple speakers of the same utterance.

Figure 6:
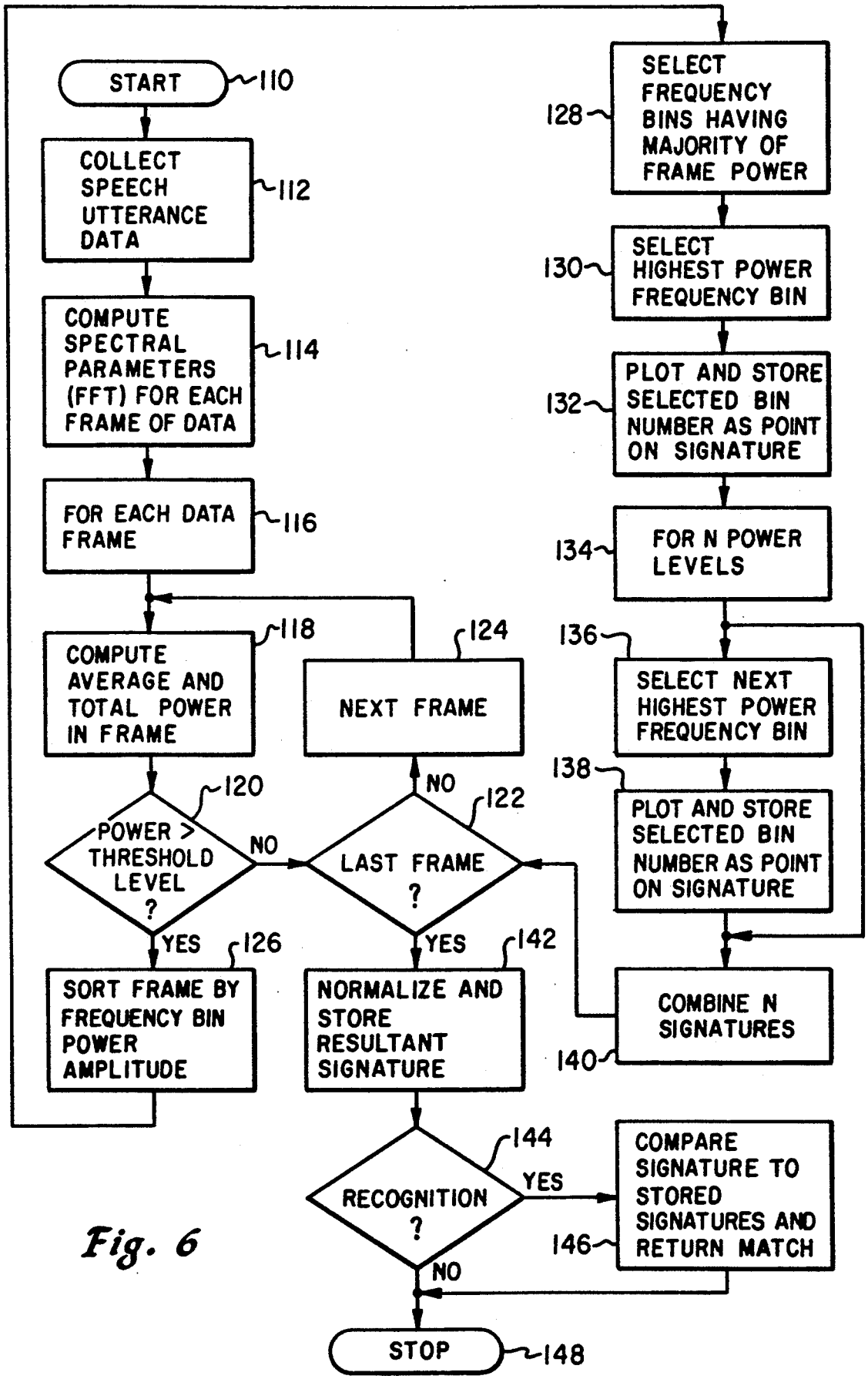
FIG. 6 is a high level logic flow chart illustrating the method of the present invention.

Referring now to FIG. 6, there is depicted a high level flow chart which illustrates the method of the present invention. As depicted, the process begins at block 110 and thereafter passes to block 112 which illustrates the collection of speech utterance data. This may be accomplished utilizing any suitable analog input device, such as a microphone, and an analog-to-digital converter, such as that depicted in FIG. 2.

Next, each frame of digitized data is analyzed to computer spectral parameters for that frame. This is accomplished utilizing a Fast Fourier Transform (FFT) in a manner well known in the art. Thereafter, as depicted in block 116, for each data frame various analysis steps are accomplished. This process begins at block 118 with the computing of the average and total power within each data frame.

Next, block 120 illustrates a determination of whether or not the power within a data frame exceeds a predetermined threshold level. The Applicant has discovered that the analysis and recognition method of the present invention determines the content of a speech utterance by a study of the power content of that utterance. Thus, those frames of data which do not include substantial amounts of power are not useful in this endeavor.

In the event the power contained within a frame under consideration does not exceed the predetermined threshold level, then the process passes to block 122 which illustrates a determination of whether or not the frame under consideration is the last frame within an utterance. If not, the process passes to block 124 which depicts the iterative nature of the method, returning to block 118 to compute the average and total power of the next frame within the speech utterance.

Referring again to block 120, in the event the power contained within a frame under consideration does exceed the predetermined threshold level, then block 126 illustrates the sorting of the frequency bins within that frame by the power amplitude of each frequency bin. Thus, the frequency bins are arranged in order beginning with the frequency bin containing the largest amount of power and sequentially thereafter down to those frequency bins which contain little or no power.

The process next passes to block 128 which illustrates the selection of those frequency bins having the majority of the power for a particular frame. In the illustrated embodiment of the present invention a sufficient number of frequency bins are selected to represent at least seventy-five percent of the power within a particular frame. Block 130 now illustrates the selection of the highest power frequency bin from the selected frequency bins. This frequency bin number is then plotted and stored, as depicted in block 132 and becomes a point on a power content signature which is to be created utilizing the method and apparatus of the present invention.

Next, for an additional number of power levels, as illustrated in block 134, the next highest power frequency bin is selected, as depicted in block 136. Block 138 then illustrates the plotting and storing of this selected bin number as a point on another signature. The process then iterates through block 136 and block 138 until such time as a sufficient number of power levels have been plotted. In the depicted embodiment of the present invention, the eight most significant power levels for each frame are plotted in this manner.

After plotting the eight most significant frequency bin numbers, in a manner such as that depicted in FIG. 4, the process passes to block 140 which illustrates the combining of the eight signatures into a single power content signature in the manner described above. Thereafter, the process returns to block 122 for a determination of Whether or not the frame under consideration is the last frame within the utterance. If not, the process passes to block 124 and repeats in the manner described above.

Referring again to block 122, in the event the frame under consideration is the last frame within the speech utterance, then the process passes to block 142 which illustrates the normalization and storing of the resultant signature. Thereafter, the process passes to block 144 which illustrates a determination of whether or not recognition of the speech utterance is desired. If so, the process passes to block 146 which illustrates a comparison of the stored signature to a plurality of stored signatures, each associated with a known speech utterance. Those skilled in the art will appreciate that the two such waveforms may be compared utilizing a least squares fit or any other suitable technique. After determining which stored signature is the closest match to the signature obtained from the unknown speech utterance a return of a match for that utterance is accomplished. Thereafter, or in the event a recognition of the speech utterance is not desired, the process returns to block 148 and terminates.

Upon reference to the foregoing, those skilled in the art will appreciate that the Applicant of the present application has developed a technique whereby the intelligence content of a speech utterance may be determined by creating a novel power content signature associated with that utterance which may then be compared to previously stored power content signatures which are each associated with a known speech utterance. By utilizing a power content signature of the type disclosed herein, variations in speech amplitude envelopes due to sex, age or regional differences are largely eliminated.

While the invention has been particularly shown and described with reference to a preferred embodiment, it will be understood by those skilled in the art that various changes in form and detail may be made therein without departing from the spirit and scope of the invention.

I claim:

1. A method for analyzing human speech, said method comprising the steps of:

representing a speech utterance as a temporal sequence of frames, each frame representing acoustic parameters at one of a succession of brief time periods;

analyzing each frame of acoustic parameters to obtain a plurality of spectral parameters, each of said plurality of spectral parameters representing an energy level at one of a series of different frequency bins;

identifying a spectral parameter within each frame having the highest energy level within that frame; and plotting an indication of said spectral parameters having the highest energy level for each frame in said temporal sequence to form a first continuous signature representative of said speech utterance.

2. The method for analyzing human speech according to claim 1, further including the step of identifying a second spectral parameter within each frame having the second highest energy level within that frame.

3. The method for analyzing human speech according to claim 2, further including the step of plotting an indication of said second spectral parameter having the second highest energy level for each frame ins aid temporal sequence to form a second continuous representative of said speech utterance.

4. The method for analyzing human speech according to claim 3, further including the step of combining said first continuous signature and said second continuous signature to form a single continuous signature.

5. The method for analyzing human speech according to claim 1, further including the step of identifying a plurality of spectral parameters within each frame having high energy levels.

6. The method for analyzing human speech according to claim 5, further including the step of plotting an indication of each of said plurality of spectral parameters for each frame to form a composite continuous signature representative of said speech utterance.

7. A method for recognizing human speech, said method comprising the steps of:

representing a speech utterance as a temporal sequence of frames, each frame representing acoustic parameters at one of a succession of brief time periods;

analyzing each frame of acoustic parameters to obtain a plurality of spectral parameters, each of said plurality of spectral parameters representing an energy level at one of a series of different frequency bins;

identifying a spectral parameter within each frame having the highest energy level within that frame;

plotting an indication of said selected spectral parameters having the highest energy level for each frame in said temporal sequence to form a first continuous signature representative of said speech utterance; and comparing said first continuous signature representative of said speech utterance with a plurality of stored signatures representative of selected speech utterances.

8. The method for analyzing human speech according to claim 7, further including the step of identifying a second spectral parameter within each frame having the second highest energy level within that frame.

9. The method of analyzing human speech according to claim 8, further including the step of plotting an indication of said second spectral parameter having the second highest energy level for each frame in said temporal sequence to form a second continuous signature representative of said speech utterance.

10. An apparatus for analyzing human speech, said apparatus comprising:

audio input means for receiving a speech utterance;

sampling means for creating a temporal sequence of frames, each frame representing acoustic parameters at one of a succession of brief time periods;

transform means for determining a plurality of spectral parameters, each of said plurality of spectral parameters representing an energy level at one of a series of different frequency bins;

processor means for identifying a spectral parameter within each frame having the highest energy level within that frame; and means for plotting an indication of said spectral parameters having the highest energy level for each frame in said temporal sequence to form a first continuous signature representative of said speech utterance.

11. The apparatus for analyzing human speech according to claim 10, wherein said audio input means comprises a microphone.

12. The apparatus for analyzing human speech according to claim 10, wherein said sampling means comprises digital sampling means for digitizing said speech utterance at a selected sampling rate.

13. The apparatus for analyzing human speech according to claim 12, wherein said selected sampling rate comprises eighty-eight kilohertz.

14. The apparatus for analyzing human speech according to claim 10, wherein said processor means comprises a digital signal processor.

15. An apparatus for recognizing human speech, said apparatus comprising:

audio input means for receiving a speech utterance;

sampling means for creating a temporal sequence of frames, each frame representing acoustic parameters at one end of a succession of brief time periods;

transform means for determining a plurality of spectral parameters, each of said plurality of spectral parameters representing an energy level at one of a series of different frequency bins;

processor means for identifying a spectral parameter within each frame having the highest energy level within that frame;

means for plotting an indication of said spectral parameters having the highest energy level for each frame in said temporal sequence to form a first continuous signature representative of said speech utterance; and comparison means for comparing said first continuous signature representative of said speech utterance with a plurality of stored signatures representative of selected speech utterances.

16. The apparatus for analyzing human speech according to claim 15, wherein said audio input means comprises a microphone.

17. The apparatus for analyzing human speech according to claim 15, wherein said sampling means comprises digital sampling means for digitizing said speech utterance at a selected sampling rate.

18. The apparatus for analyzing human speech according to claim 17, wherein said selected sampling rate comprises eighty-eight kilohertz.

19. The apparatus for analyzing human speech according to claim 15, wherein said processor means comprises a digital signal processor.

* * * * *